United States Patent [19]

Petit

[11] Patent Number: 4,611,775

[45] Date of Patent: Sep. 16, 1986

[54] RAILWAY TRACK SWITCH CONTROL APPARATUS

[75] Inventor: William A. Petit, Spencerport, N.Y.

[73] Assignee: General Signal Corp., Rochester, N.Y.

[21] Appl. No.: 566,855

[22] Filed: Dec. 29, 1983

[51] Int. Cl.[4] ..... B61L 19/06

[52] U.S. Cl. ..... 246/28 F; 246/122 R; 246/220

[58] Field of Search ..... 246/5, 28 F, 34 R, 34 A, 246/34 CT, 122 R, 220

[56] References Cited

U.S. PATENT DOCUMENTS 4,217,643 8/1980 Anderson et al. ..... 246/182 X 4,305,556 12/1981 Norton et al. ..... 246/5

*Primary Examiner*—Robert B. Reeves

*Assistant Examiner*—Edward M. Wacyra

*Attorney, Agent, or Firm*—Martin LuKacher

[57] ABSTRACT

A railway track switch, also known as a switch machine, is controlled by a microprocessor switch lock connected to the electric switch lock of the switch machine and permits the switch machine to be unlocked so that the track switch points may be thrown, as by a hand-throw mechanism, to permit movement of a train between main and secondary tracks. The switch lock is connected to a cut section repeater of the track circuit adjacent to the track switch. An overlay track circuit connected to the main tracks indicates occupancy in the vicinity of the track switch. The microprocessor receives signals from the repeater, the overlay circuit and the electric switch lock of the switch machine indicating track occupancy and requests to unlock the track switch so that the switch points may be moved. Signals are also received from a timer as to specific, selected delay times set by the user before unlocking the switch. An interface also controls the microprocessor to decode occupancy and other track codes, transmitted by the track circuits and received by the repeater, as are selected by the user to enable the apparatus to be used with any track circuit communication code protocol. The microprocessor cooperates with a hardwired counter and is programmed to provide continuous checks for vital operation.

11 Claims, 5 Drawing Figures

RAILWAY TRACK SWITCH CONTROL APPARATUS

DESCRIPTION

The present invention relates to railway track switch control apparatus and particularly to microprocessor based apparatus for controlling the unlocking of an electric switch lock for the switch machine by which the switch points of the track switch are thrown to permit movement of trains between main and secondary tracks over the track switch so that trains on the secondary tracks (for example, of a siding) may move onto the main tracks and trains on the main tracks may move onto the secondary tracks.

The invention is especially suitable for use with coded track circuits where track signals coded in the form of pulses of opposite polarity are transmitted along cut sections of the rails through repeaters which are connected across insulating joints separating the successive sections. Apparatus for such coded track circuit control is available from the General Railway Signal Company of Rochester, N.Y. as its Trakode coded track signal system. The Trakode system is available in relay and in solid state microprocessor based versions, insofar as the signal control and track signal communication modules thereof are concerned. The Trakode system is described in the text, *Elements of Railway Signalling,* published by the General Railway Signal Company (Rochester, N.Y., 1979). The solid state, microprocessor based signal control apparatus, known as Trakode II is described in U.S. patent applications Ser. No. 356,861 filed Mar. 10, 1982 in the names of Barry L. Smith, James R. Hoelscher and William A. Petit, which is assigned to the same assignee as the present application (now U.S. Pat. No. 4,498,650). The switch lock with which a controller in accordance with the invention is especially adapted for use may be of the type which locks the hand-throw lever or crank of the switch machine. Such locks are sold by the General Railway Signal Company of Rochester, N.Y., as their Model 9B or Model 10. Of course, power switch machines and their switch locks may be unlocked through the use of a controller embodying the invention.

In normal operation, railway personnel operating a train wishing to move onto or off a secondary track, manually operate the switch lock by depressing a latch and removing a switch padlock. This action outputs signals requesting an unlocked condition. The controller of the present invention is especially suitable for use with the track circuits and the switch lock to prevent the hand-throw lever or crank of the switch machine to be unlocked when the main line track is occupied as indicated by the track circuit, except under certain conditions, and to prevent transmission of signals along the track circuits operative to clear the wayside signals (to a green or go condition) when an unlocked condition is requested by operating the switch lock.

Heretofore, relay circuits have been used for the control of electric switch locks in regular railway operation. Such relay controllers are custom designed for the track circuit protocols in the particular railway territory where they are used. While such relay controllers have been used successfully to provide safe railroad operation for many years, it is desirable to utilize solid state, and particularly integrated circuit, equipment to benefit from the attendant savings in space and maintenance effort. However, the use of integrated circuits, including microprocessors, for control of switch locks presents problems engendered by the need for vital (fail-safe) operation and compatibility with various railway signalling protocols used in the different railway territories without requiring special designs, including programming, for use in each territory.

Accordingly, it is the principal object of the present invention to provide improved apparatus for controlling a switch lock in response to track circuit conditions and to control communication along the track circuit in response to switch lock conditions, which is vital in operation and provides the flexibility of control necessary and desirable for regular railway use.

It is a still further object of the present invention to provide improved switch lock control apparatus which operates vitally to perform all desired and necessary control over the switch lock and associated track circuits and which is compatible with different railway signalling protocols and especially the track codes indicative of the presence and lack of track occupancy in different railroad territories, with the same equipment.

It is another object of the present invention to provide an improved switch lock control module which may be connected to a cut section repeater and to one or more switch locks for controlling of switch locks and the track circuits through the repeater in response to unlock requests and to the occupancy of the main tracks from and to which trains are switched by the switch points operated by switch machines associated with the switch locks, which switch lock control module is microprocessor based, integrated circuit equipment.

Briefly described, apparatus in accordance with the invention for unlocking a track switch which provides an unlocking output when an unlocked condition is requested, as from the switch lock of the track switch, is used with a repeater connected to main tracks on opposite sides of the insulated joints of a pair of successive sections of the main track, adjacent to one of which the switch points of the track switch are located. The repeater receives and transmits pulses representing the presence and lack of train occupancy in the sections of the track for controlling wayside signals. The unlocking apparatus utilizes switch lock control means having microprocessor means connected in controlling relationship with the track switch and the repeater. The microprocessor means has means for vitally checking the operation thereof for enabling the microprocessor means to provide outputs for enabling the unlocking of the track switch and the transmission of signals operative to clear the wayside signals only in the absence of a failure of the microprocessor means. The microprocessor means also has means responsive to the unlocking output for inhibiting the transmission of signals operative to clear the wayside signals by the repeater. The microprocessor means also has means responsive to the track occupancy signals from the repeater indicative of the lack of occupancy and to the unlocking output (the request to unlock the track switch) for generating the unlocking enabling output.

An overlay circuit for detecting track occupancy in the vicinity of the track switch provides a local occupany output to which the microprocessor means is responsive. Timer means also provides outputs to the microprocessor means indicative of selected time delays, for example from one second to nineteen minutes, fifty-nine seconds as set by the user (the railroad personnel operating the railway territory in which the apparatus is installed). The microprocessor means is responsive to the timer and overlay circuit outputs to generate the unlocking enabling output after the selected time delay when the overlay is not occupied even if outputs from the repeater indicate that the main track is operated, thereby enabling the train on the main track to be observed by the trainmen or other train operating personnel during the preset time delay. When the train passes the track switch may be thrown by the trainman so as to enable the train to proceed from the secondary to the main tracks. The apparatus also has interface means associated with the microprocessor means for controlling the decoding of the track circuit signals received by the repeater in accordance with a protocol selected by the user, thereby permitting the apparatus to be used in any railroad territory regardless of the track signal protocol adopted therein.

The foregoing and other objects, features and advantages of the invention, as well as a presently preferred embodiment thereof, will become more apparent from a reading of the following description in connection with the accompanying drawings in which.

An overall program, an executive program and subroutines are described in an unpublished appendix contained in the patented file which show the implementation of a presently preferred embodiment of the system utilizing an Intel type 8085 microprocessor chip with associated memory and port chips.

Figure 1:
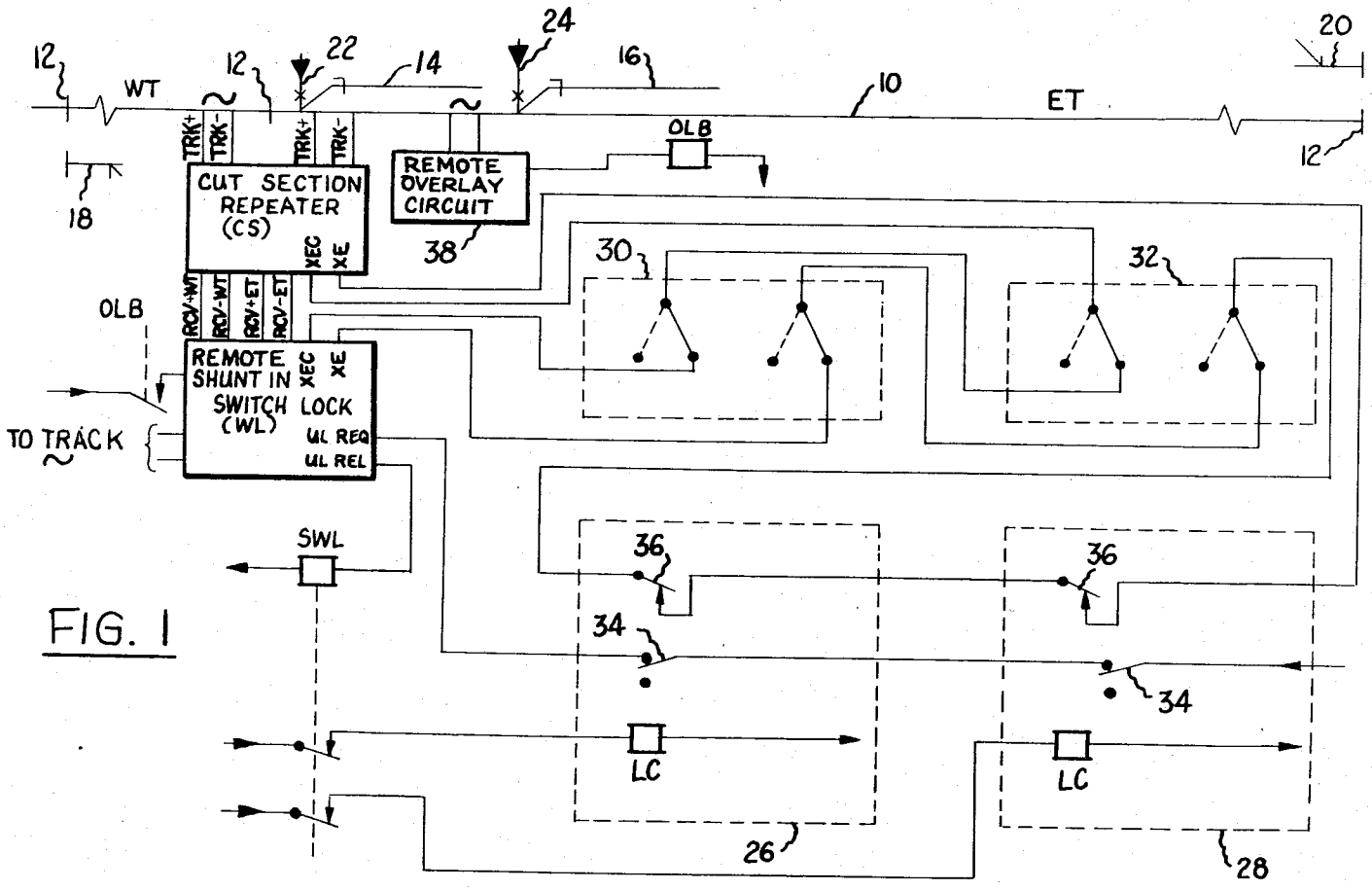
FIG. 1 is a block diagram, schematically illustrating apparatus in accordance with the invention for controlling the switch locks associated with two track switches.

Referring first to FIG. 1, there is shown a main track 10. This track has successive sections separated by insulated joints 12 (cut sections of rails). Secondary tracks 14 and 16, shown as sidings, are located adjacent to one of the sections of tracks. Two sections of track which are westerly and easterly of a joint 12 define track circuits (WT and ET) on opposite sides of the joint 12. The westerly section is guarded by a wayside signal 18 and the easterly section is guarded by another wayside signal 20. The switch points of the secondary track 14 closest to the joint 12 between the westerly and easterly tracks are operated by a switch machine 22. The switch points for the remote secondary tracks 16 are operated by another switch machine 24.

These switch machines or track switches have separate switch locks 26 and 28 and switch circuit controllers 30 and 32 associated therewith. The switch locks are illustrated as General Railway Signal model 9B locks and have lock coils LC which electromagnetically allow the lock bar of the track switch to be released when energized. These switch locks also have contacts 34 on a handle which is operated when the padlock on the cover of the switch lock is removed. The contacts are normally open and are closed by the handle causing battery voltage (+12 v) to be applied thereby providing an unlocking request output. The switch locks 26 and 28 also have emergency release contacts 36 which are connected through double break contacts in the switch controllers 30 and 32. The switch controllers are part of the switch machine and are operated with the switch points from their normal position as shown in FIG. 1 by the solid lines to the open position shown by the dash lines when the switch points are in their thrown position. The normal position of the switch points removes them from the main line rails so that the train will move on the main line and not be diverted to the secondary tracks. The thrown position of the switch points diverts the trains to the secondary tracks.

The track circuits are connected to a repeater (CS) which vitally receives and transmits track signals in the form of track codes on the TRK+ and TRK− lines which are connected to the WT and ET circuits on opposite sides of the joint 12. The repeater is preferably a cut section repeater of the Trakode or Trakode II type. These cut section repeaters are described in General Railway Signal pamphlets 1775 and 1775B. The relay type track code repeater is also described in the above referenced "*Elements of Railway Signalling*" text.

The repeater (CS) has a transmit enable input (XE) and a transmit enable common input (XEC) which are connected through contacts in the switch controllers 30 and 32.

The repeater (CS) supplies track code signals received from the WT and ET track circuits to a switch lock module (WL). The module (WL) also has transmit enable outputs (XE) and transmit enable common outputs (XEC) which are applied via the switch controllers 30 and 32 to enable communication between the WT and ET track circuits (repeating codes) transmitted on these circuits across the joint 12. These outputs XE and XEC may provide operating energy to the repeating and transmitting circuits of the repeater (CS).

The switch lock (WL) contains a microprocessor chip, memory chips, port chips and other circuits which will be described in greater detail hereinafter in connection with FIG. 3. The switch lock (WL) also has a built in overlay circuit which is suitably a series overlay circuit of conventional design which is connected to the westerly track at the TRK+ and TRK− inputs thereto on points on the rails of the track preferably directly opposite to each other, and suitably approximately 75 feet from the switch points of the track switch which is connected to the adjacent secondary rails 14. The series overlay applies alternating current to the rails. The impedance change in the rails due to the presence of a train, the axles of the cars of which shunt the rails, causes the generation of an input indicating the occupancy of the main line in the immediate vicinity of the switch points for the local secondary tracks 14 (the switch point operated by the local switch machine 22). Another series overlay circuit 38 is provided for detecting local occupancy of the main line adjacent to the switch points of the remote secondary tracks 16. When occupancy is detected by the remote overlay circuit 38, a relay (OLB) is energized which applies voltage through the OLB contacts thereof to a remote shunt input of the switch lock (WL).

The switch lock (WL) has an unlock release vital output (UL Relay) which operates a vital relay (SWL) to energize the lock coils (LC) of the switch locks 26 and 28. The switch lock (WL) also has an input (UL-REQ) for the unlocking request from the switch locks which is generated when the contacts 34 close.

It will be appreciated, of course, that only a single switch lock will be used if there is no remote secondary tracks in the same rail section. Then, only one switch controller and one switch lock is used. The unlock release output may go, optionally, through contacts of a supervisory control relay (WLZR), which is not shown, to the lock coil (LC).

The switch lock module (WL) performs the following functions. It decodes information from the repeater (CS) received over the RCV+WT, RCV−WT, RCV+ET and RCV−ET lines and determines if the WT or ET circuits are occupied or not. The switch lock (WL) has an interface containing integrated circuit port chips which are connected to the terminals of connectors which receive jumpers. The jumpers are inserted into the connectors so as to select codes showing valid track occupancy depending upon the track codes used in the railroad territory. Codes showing valid lack of train occupancy (un-occupancy) are therefore selectable by the user so that inverse codes, or any other codes not used for clearing the wayside signals 18 and 20 (FIG. 1), will not be interpreted as unoccupied track by the switch lock (WL).

If the overlay track circuit incorporated in the switch lock (WL) or the remote overlay circuit 38 indicates occupancy, the repeater (CS) is inhibited from communicating (repeating) and from transmitting track clearing codes. Then the UL RELAY output is immediately provided to energize the lock coil so that the switch may be unlocked.

A timer in the switch lock (WL) has a selector set by the user, specifically a passive device which has a matrix of output terminals, different ones of which are set to logic levels so as to select a delay time of from one second to nineteen minutes and fifty-nine seconds. These terminals are scanned to provide a delay time input. When the information from the repeater (CS) indicates track occupancy and the overlay circuit indicates that the main track is not occupied in the vicinity of the switch, the switch lock coil is energized in the presence of an unlocking request after the delay time. This delay time is selected to be sufficiently long to permit a train to pass the track switch. The switch can then be thrown to permit a train on the secondary track to move onto the main track and retain safe operating conditions.

Figure 2A:
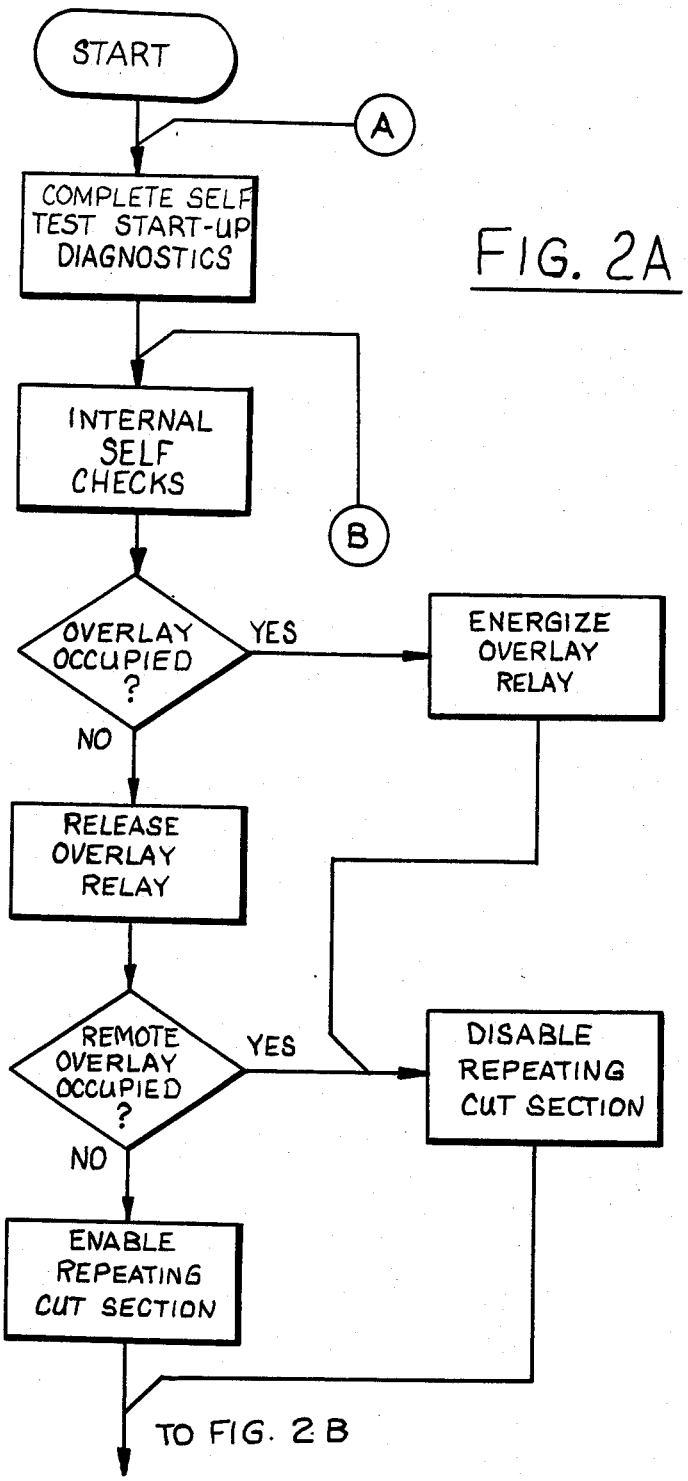
FIG. 2A and FIG. 2B is a flow chart describing the program of the microprocessor utilized in the switch lock module shown in FIG. 1.
Figure 2B:
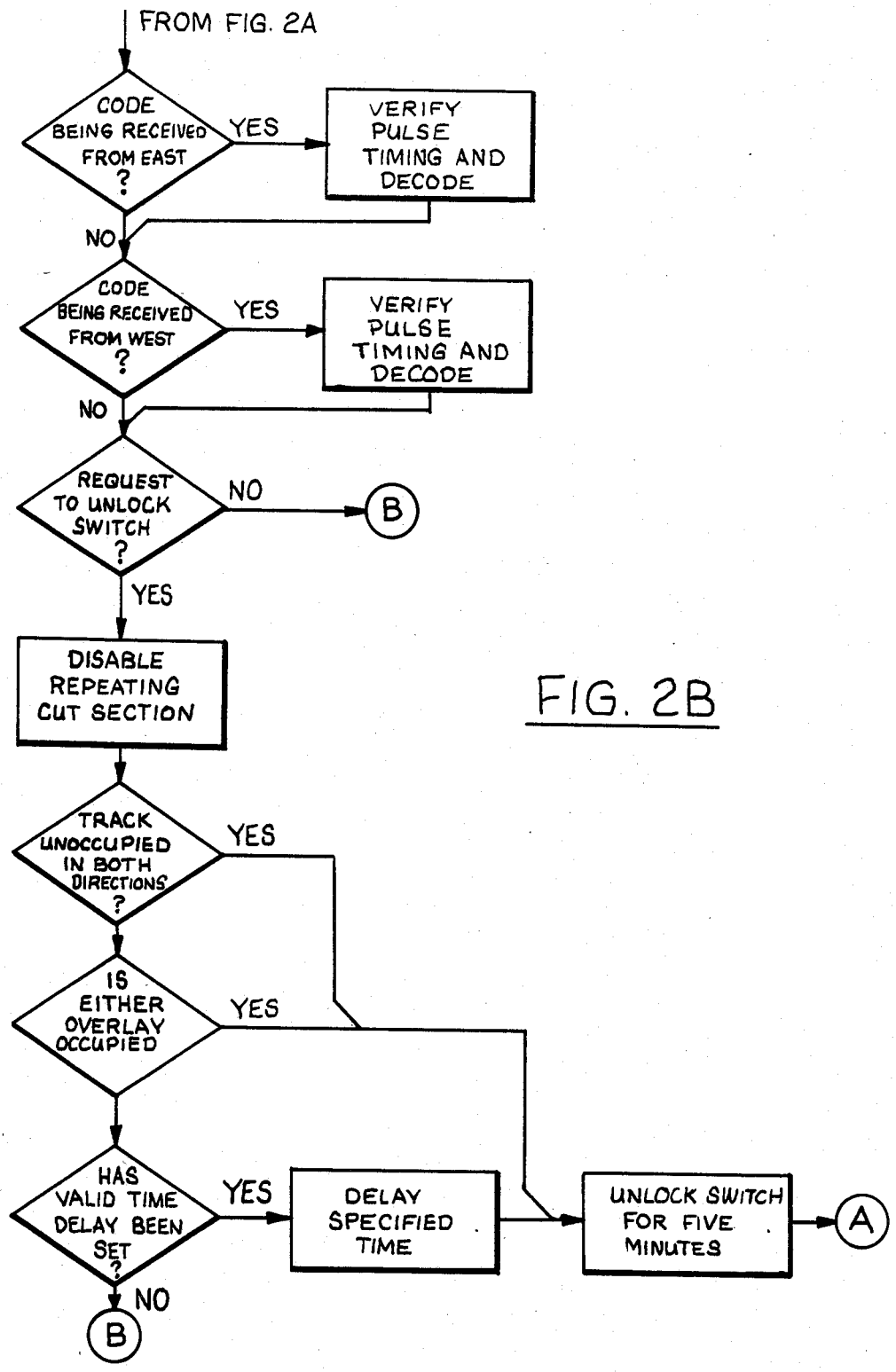

The programming of the microprocessor in the switch lock (WL) to provide the foregoing functions as well as other operations of the switch lock will be apparent from a consideration of the flow chart shown in FIG. 2A and FIG. 2B. Upon start up, the microprocessor conducts a complete self test, running through start up diagnostics and internal self checks. If no unlock request is made, the repeater (CS), described as the "repeating cut section" in the flow chart, continues normal repeating action. An output is provided which permits current flow from the transmit enable (XE) to the repeater (CS). The program follows the path returning through the connectors (B) after the request to unlock switch gives a negative result until one of the following events occurs:

(1) The overlay track circuit in the switch lock (WL) or the remote overlay circuit 38 indicates occupancy. During normal operation this has no affect on operation. However, it provides a method for detecting the failure of the overlay circuits, since the repeater (CS) will not repeat code when the overlay circuits shown occupancy.

(2) Any of the contacts 36 in the switch locks 26 and 28 or the contacts in the switch controllers 30 and 32 are open that connect the transmit enable (XE) from the switch lock (WL) to the repeater (CS). This can detect a failure in the switch locks 26 and 28 or that the track switch is out of correspondence (the switch points are not fully in normal or reverse position).

(3) A request is made to unlock a track switch. As noted above, a request to unlock a track switch is normally made by unlocking the padlock and moving the operating handle to the preliminary unlock position. This closes the contacts 34 and places voltage on the UL REQUEST input of the switch lock (WL). When an unlock request is received, the repeater CS is inhibited from transmitting or repeating code. The transmit enable (XE) voltage is immediately shut off, causing all repeating action to stop. Should battery voltage not reach the switch lock (WL), the transmit enable (XE) voltage is also broken through a contact (not shown in FIG. 1) operated by the handle on the switch lock. However, the switch lock cannot be unlocked automatically unless the unlock request output is actually applied to the switch lock (WL) module.

Once the unlock request is made, the switch lock (WL) immediately compares the codes that have been received and decoded with valid codes for track occupancy. These valid codes are set by the user by jumpers in the interface of the switch lock (WL) as explained above. These valid codes consist of signal clearing codes and do not include inverse codes, for example. For a code to be decoded by the switch lock (WL), it must be received at least twice consecutively and then at least once during the previous ten seconds. If no code is received and decoded in the last ten seconds, it is treated as an indication of main track occupancy. If both the WT and ET track sections are unoccupied, the UL Relay output appears, the lock coil in the switch locks is energized and unlocking of the track switch is permitted. If the main line track circuits indicate occupancy, the overlay circuits are checked for occupancy. If the main line tracks in the vicinity of the track switches are occupied, the lock coil is energized and the switch locks are unlocked. If the main line track is occupied in one or both directions and neither overlay is occupied, a check is made for a valid time delay from the timer. The timer section of the switch lock (WL) is started to allow for a user set time delay from one second to nineteen minutes fifty-nine seconds before the switch is unlocked.

After setting the timer in the switch lock (WL), a cover is placed over the timer selector and locked using wire locks to protect against tampering. If it is not desired to use the time delay, the timer can be set so that the time delay is not run. This can be done by a setting of the pins in the matrix on the timer. In the later case the switch is not unlocked until both WT and ET are clear or the overlays are occupied (no code repeating action takes place during this time).

After the required conditions for unlocking are met, energy is provided to the lock coil to unlock the switch lock for approximately five minutes or until the unlock request is no longer present (whichever is shorter). Once either of these conditions occurs, the switch lock program repeats. If the unlock request remains after five minutes, the conditions for unlocking must be reestablished (the program is run through again) before unlocking.

It may be desirable to use an NWLP relay to pass code around the joint 12 instead of using the repeater (CS). The connections to the relay are similar to those set forth above except that the transmit enable (XE) voltage energizes the NWLP relay instead of enabling the repeater (CS). The NWLP relay is connected between XE and XEC. When the relay is energized, front contacts by-pass the insulated joint 12. This is the normal operation of this configuration. When the relay is de-energized, code is no longer passed around the joints since the front contacts are no longer made. Polarity is changed across the joints to provide detection of insulated joint breakdown. The back contacts of the NWLP can be used to shunt each side of the joint. The repeater (CS) is still used in the system to receive incoming code from the track circuits (WT and ET).

For further information as to the programming of the microprocessor, implemented using an Intel 8085 chip, reference made be had to the appendix hereto.

Figure 3A:
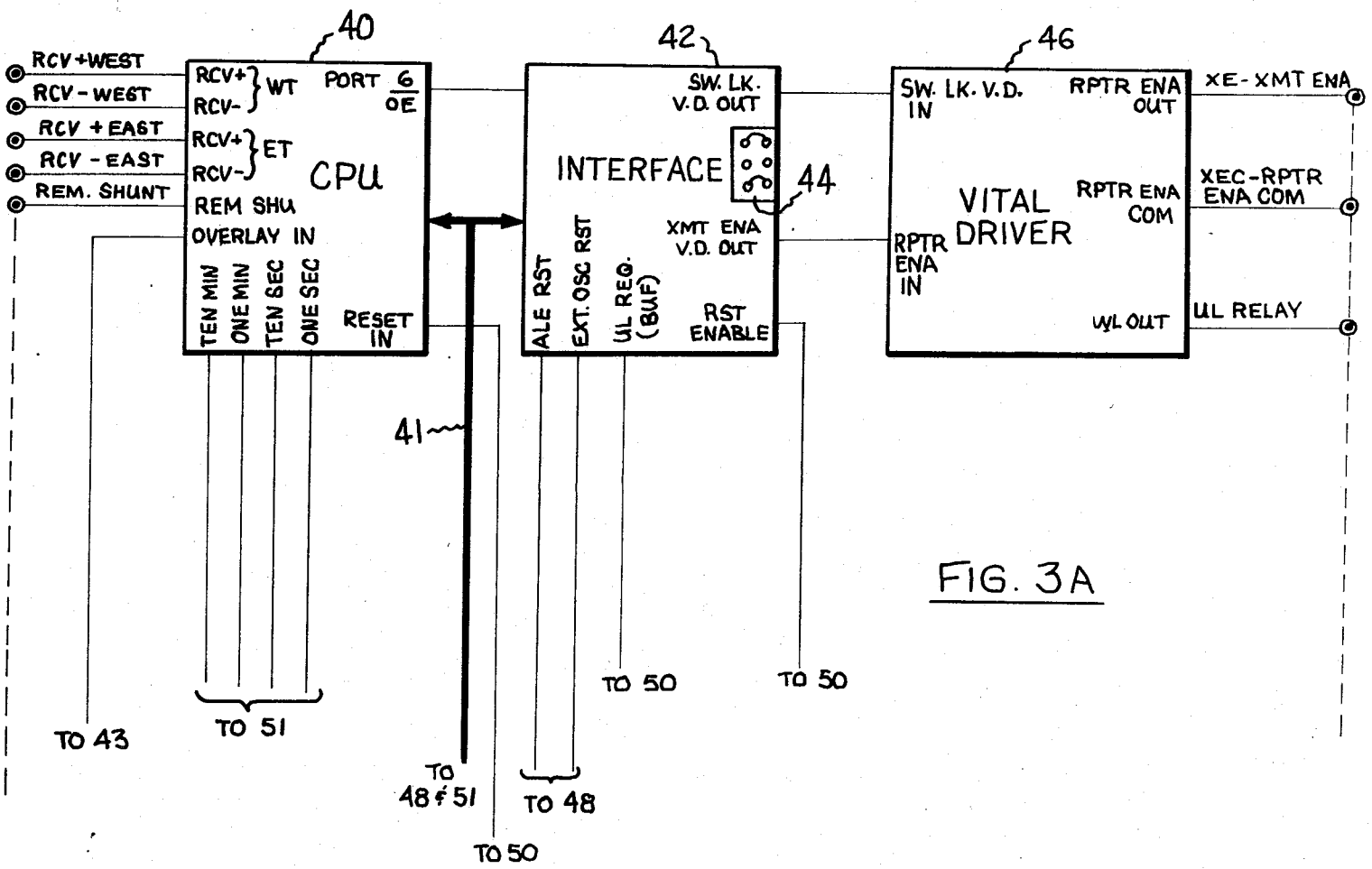
FIGS. 3A and 3B is a more detailed block diagram of the switch lock module illustrated in FIG. 1.
Figure 3B:
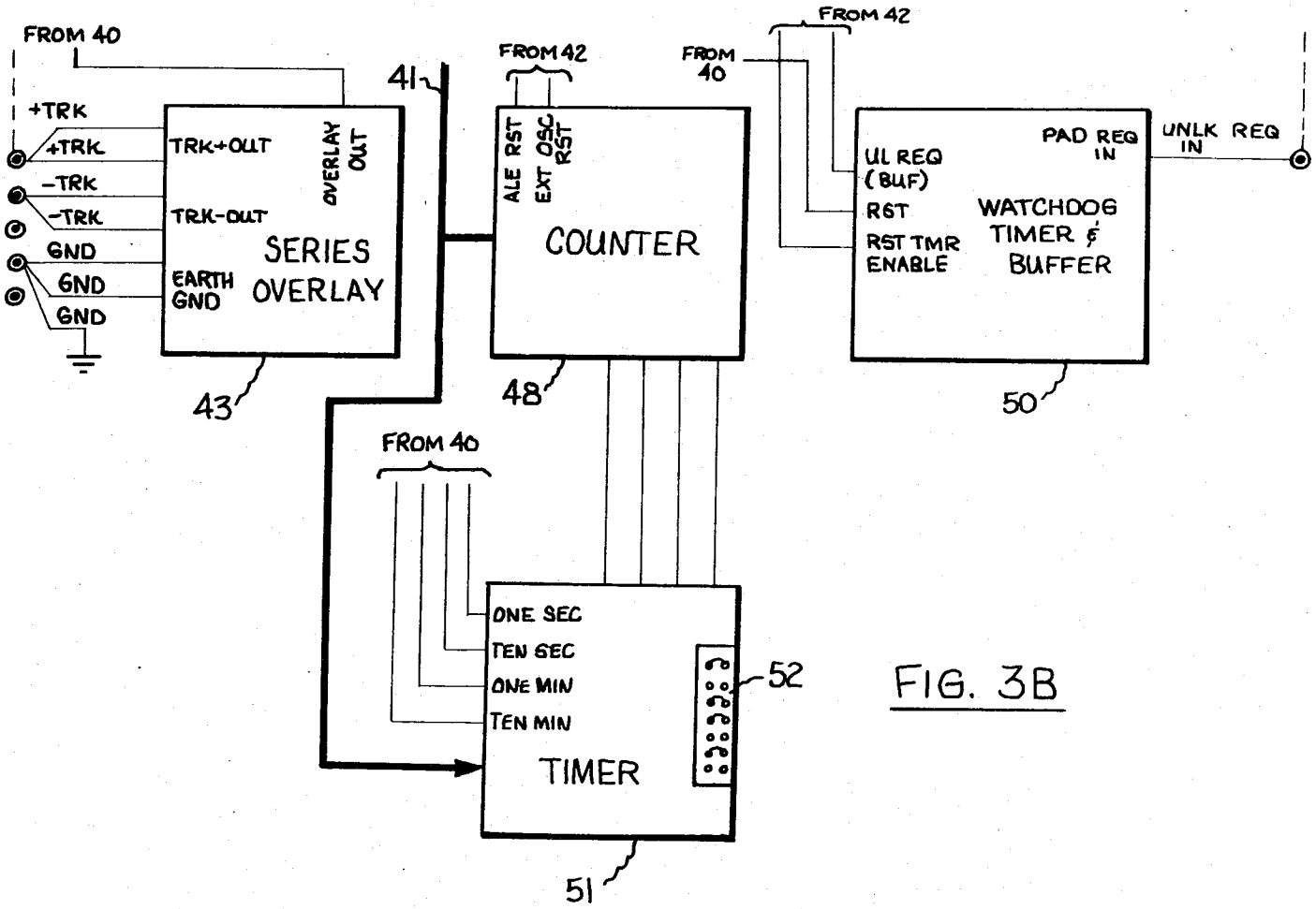

Referring to FIG. 3A and FIG. 3B, it will be seen that the switch lock WL utilizes a central processing unit 40. This unit contains the microprocessor chip, memory chips (suitably read only memories which may be EPROMs) a random access (RAM) or read/write memory chip and imput/output port chips which latch digital signals transmitted along the data and address bus 41 which interconnects all of the chips. The microprocessor chip also has an address latch enable (ALE) line which is carried along the bus 41.

The architecture of the switch lock (WL) is based upon the use of the ports to handle digital signals from the outside, such as the RCV inputs from the west and east which are of opposite polarity. The interface 42 also contains the port chips which provide input and output ports controlled by the CPU over the data and address bus 41. The output port also contains the connectors or jacks 44 into which jumpers are inserted by the user to select the valid codes to indicate track unoccupancy. The interface 42 provides outputs to a vital driver 46 in the form of 4,386 Hz pulses which are decoded in the vital driver through the use of tuned circuits and detectors to provide output voltages on the XE-transmit enable, XEC-transmit enable common and the UL Relay output lines. These vital driver circuits may be of the type heretofore used in vital drivers.

The series overlay circuit 43 may also be of conventional design, and it provides an output to a central processor overlay input on one of the central processor input ports. Another input through the central processor, labeled remote shunt, is provided for the input through the contacts of the OLB relay which is operated by the remote overlay circuit 38 (FIG. 1).

A counter unit 48 has two counters one which counts the ALE pulses. An external oscillator clocks the other counter at several points within the program. The ALE count is then read into the microprocessor as a check word for use in the vital checks conducted in the microprocessor. Similarly, the counter which counts the external oscillator is reset upon command from the microprocessor to the interface 42, and the count stored in the external oscillator counter is compared with a count of the clock in the oscillator used for microprocessor chip so as to vitally check the timing in the switch lock (WL).

The timer 51 has a plug board matrix 52 in which plugs may be inserted to select the time delay. The plugs are arranged in a matrix of 4 rows and 10 columns. By inserting 4 plugs, 10's of minutes, units of minutes, 10's of seconds and units of seconds can be set for read out from an output port on the timer 51. The timing for reading of the columns may be provided by port chips located with the counters 48 on the same board for convenience in construction. Four lines which transmit codes indicative of the 10's of minutes, units of minutes, 10's of seconds and units of seconds from the timer to the CPU 40 provide outputs for setting the selected time into the CPU for processing.

A watchdog timer and buffer 50 provides a reset input to the CPU 40. The CPU generates a reset enable which is read from an output port in the interface 42 and periodically resets retriggerable, monostable, multi vibrators in the watchdog timer, for example every 50 miliseconds. If no reset appears after approximately five seconds, an output level on the reset timer enable resets the entire system and attempts to reinitialize. Of course, if there is a failure in the system the transmit enable (XE) and transmit enable common (XEC) as well as the unlocking output (UL Relay) drop away so that safe signalling conditions are maintained and the track switch cannot be unlocked. Buffer amplifiers in the timer transmit the unlock request to the CPU via an input port on the interface 42.

The programming of the microprocessor enables the system to vitally check itself and provide vital operation. The results of these vital checks enable a routine which outputs 4,386 Hz outputs through the interface 42 when all of the checks are passed. The vital driver 46 detects this signal to provide the XE, XEC and UL Relay outputs as required, depending upon the unlock requests, the track codes which are decoded by the CPU 40 and the outputs from the overlay circuits 41 and 38. In the event of a system failure, this 4,386 Hz frequency is not present or not at the correct frequency to allow the vital driver 46 to provide the enable and UL Relay outputs. The transmit enable output power the repeater (CS) so that no code will be passed around the joint 12 in the event of a system failure.

Two circuits may be used in the vital driver 46, one for providing the enabling voltages (XE) for the transmitter and the transmitting repeaters of the repeaters (CS). The other vital driver circuit may be used to provide energy (UL Relay) for unlocking the switch locks 26 and 28 (FIG. 1). The vital checks which are performed are similar to those used in the Trakode II equipment and are described in detail in the above referenced U.S. Pat. No. 4,498,650. The programming of the microprocessor to provide vital operation may be of the type described in U.S. Pat. No. 4,181,842 issued Jan. 1, 1980 to Henry C. Sibley wherein software counters are counted up and down. The counts set therein must be complementary digital numbers which, when one bit of one of the numbers is reversed (from 0 to 1) causes the numbers to differ by a pre-set value. Reference also may be had to U.S. Pat. No. 3,976,272 issued Aug. 24, 1976 to John R. Murray, et al and U.S. Pat. No. 4,090,173 issued May 16, 1978 to Henry C. Sibley, for further information respecting programming of a microprocessor based system for vital operations.

In the program implemented in the CPU 40 the following operations occur. Decision check operations occur whenever a logical decision must be made. The result of that decision is combined with inputs which cause the decision to be stored as a check word. The resulting check word is unique in that the path that was chosen and the result must be correct in order to enable the routine which provides the 4,386 Hz input to the vital driver 46. Condition checks or flags are provided for each logical condition that must be checked. Each such condition is assigned two unique flag values. One is for the set condition and the other is for the clear condition. These flags are stored as check words to verify that the proper condition exists for the program path taken. Input and output port checks are also made. Each input or output port is assigned a separate port whose function is to check the state of the port. At least once per cycle (approximately two seconds) each port is cycle checked. During the cycle check, each bit of the port changes state to verify that the bit is not stuck in either state and is not shorted to an adjacent bit. This test is accomplished by offsetting the input and output port by one bit and cycling one bit through the port until the bit has returned to its original position. The number of cycles that this operation takes is used as a check word.

Invalid signal checks are made when a signal is sent to an output port. Then, the associated input port is read and verified that the proper output bit of that port was indeed set or cleared as directed. The result of this check is used as a check word. In addition, when an input is read, it is checked so that no other inputs are present which would lead to an illegal condition for the system. These inputs are stored as check words to verify that only the proper inputs are present. ALE pulse checks, referred to above, are also made. ALE pulses from the microprocessor in the CPU 40 is emitted a specific number of times per instruction. The number of ALE pulses varies with the type of instruction. These pulses are counted by a counter in the counter board 48 and stored as a check word as various parts of the program. The check word is used to verify that the program path taken was correct and that all of the instructions were executed.

Also as noted above, the clock oscillator in the CPU chip is checked by means of a separate oscillator which is used to drive one of the counters of the hardware counters 48. The output of this hardware counter is checked during the checking of the input and output ports to verify that the clock oscillator of the microprocessor chip is running at the correct frequency and that the input/output port checks took the correct amount of time to be performed correctly. The check work from the counter also is used as one of the methods to verify that the time delay selected by the timer 50 is correct.

The read/write memory is checked to verify that the contents of the RAM are not permanently stored therein. This is done by writing known data into RAM (the scratch pad read/write memory which is part of the CPU 40). This known data is verified that it is correctly stored. This known data is then stored as a check word. This check word verifies that the vital driver 46 is not permanently enabled and that critical data is refreshed periodically and not permanently stored in RAM.

The vital driver routines take software counter values formed from the check words to create the necessary 4386 Hz frequency signal for the vital driver 46. A separate software up and down counter is used for each vital driver circuit. These counters have counts which correspond to each other. During the vital driver routine the counters are moved up and down in relationship to each other four different times and must maintain the proper relationship (complementary values offset by a fixed value, for example decimal 2, as explained above). This verifies that the counters are not stuck at a certain value. The value of these counters determines the length of time that the vital driver output is present. If these counters count to zero before they are reset by the check words, the vital driver output frequency will stop. The routines in the software which read the timer 50 are similar to the vital driver routines and utilize software counters that are incremented and decremented and checked for proper relationship to each other. Each value of the counter corresponds to a specific time delay. The time select inputs are continuously checked as part of the input/output port checks.

During initial start-ups, several checks are made. A complete check is made to verify that all of the input and output ports are working correctly. In addition, the entire read only memory is subject to a signature analysis.

The input/output port checks are, as explained above, obtained by connecting each input line from an input port to the output lines from an output port which go to external outputs and for connecting each output line from an output port to input lines from an input port which receive external inputs. Preferably diodes may be used between the external inputs and the input ports so as to prevent circulation of data from the output port to the external inputs.

Consider the testing of an input port. Normally the input port reads whatever information is presented on the external inputs. When it is time for a cycle check, the output port is enabled and cleared. Any high inputs present will be brought low since the output port will sink the required amount of current. The series diodes in the input lines allow the output ports to keep a high input on the input ports regardless of the state of the input ports. A normal test sequence is, for example, to write 80 hex into the output port. This is read as 40 hex in the input port which is then reloaded into the output port. The 40 hex output is then read as 20 hex input. This continues until the output port has 01 hex as an output and the input port reads 80 hex. This is recognized as the end of the test. The number of iterations taken to complete the test is stored as a check word. If zero is read at any time, the program is halted. If two "1"'s or the wrong bit is set, the iteration count is wrong and the check word will be incorrect. An incorrect check word will cause the vital driver 46 to be disabled so that no codes are repeated across the joint 12. The output port is disabled at the end of the test.

For the checking of an output port which provides external outputs, a similar cycle is used as for the input port check. There is no need to disable the input port. Also when the output port is cycle checked, its previous contents must be stored and then replaced at the end of the cycle check. This is done by reading the input port before and after the check and then forming a check word by subtracting the two values.

Further information as to the vital programming carried out in the system will be available from the unpublished appendix contained in the patented file.

From the foregoing description it will be apparent that there has been provided an improved, and microprocessor based, controller for switch locks which operates vitally in connection with track circuit repeaters and may receive inputs from overlay circuits. Variations and modifications in the herein described apparatus, within the scope of the invention, will undoubtedly become apparent to those skilled in the art. Accordingly, the foregoing description should be taken as illustrative and not in a limiting sense.

I claim:

1. Apparatus for unlocking a track switch, said track switch providing an unlocking request output when an unlocked condition is requested, said track switch being disposed adjacent a section of main tracks having successive sections separated by insulated joints to enable a train to move between said main tracks and secondary tracks, a repeater connected to said main tracks on opposite sides of the one of said joints for said section which has said track switch adjacent thereto for receiving and transmitting track codes representing the presence and lack of train occupancy in said section for controlling wayside signals, said apparatus comprising switch lock means including microprocessor means, said switch lock means being connected in controlling relationship with said track switch and said repeater, said microprocessor means having means for vitally checking its operation for enabling said microprocessor means to provide outputs for enabling the unlocking of said track switch and said repeater for the transmission of signals operative to clear said wayside signals only in the absence of a failure of said microprocessor means, said microprocessor means also having means responsive to said unlocking request output for inhibiting said repeater from the transmission of the track codes operative to clear said wayside signals, said microprocessor means further having means responsive to said track occupancy signals from said repeater indicative of the lack of occupancy and to said unlocking request output for generating the unlocking enabling output, said switch lock means having vital driver means for generating signals for enabling said repeater and unlocking said track switch, and means interfacing said vital driver means and said microprocessor means for providing said unlocking enabling and transmission enabling outputs to said vital driver means and for controlling said microprocessor means.

2. The invention according to claim 1 including in said switch lock means, overlay circuit means providing inputs to said microprocessor means indicative of trains on said sections of said main track adjacent to said track switch, said microprocessor means including means responsive to the output of said overlay circuit means for providing said unlocking enabling output when the presence of a train is detected by said overlay circuit means and said repeater receives track codes representing train occupancy in said sections.

3. The invention according to claim 2 wherein said switch lock means further comprises timer means for providing outputs representing a selected time delay, and said microprocessor means including means for providing said unlocking enabling output after said predetermined time delay when said overlay circuit means output represent the lack of occupancy of a train and said repeater track codes represent occupancy in said sections.

4. The invention according to claim 1 wherein said microprocessor means has means for decoding said track codes, and said interfacing means includes means for selectively enabling said microprocessor means to decode selected track codes used in the railroad territory having said track switch.

5. The invention according to claim 4 wherein said interfacing means has a plug board for receiving jumpers to provide outputs representing said selected track codes.

6. The invention according to claim 1 wherein said switch lock means further comprises counter means for repetitively counting instructions and timing signals produced in said microprocessor means and producing outputs corresponding to counts accumulated in said counter means, and said checking means including means for verifying the operation of said microprocessor means in response to the outputs from said counter means.

7. The invention according to claim 1 wherein said vital driver means is connected to said repeater and said track switch for applying said enabling signals thereto when operated by repetitive signals having a certain frequency, and said microprocessor means including means for generating said enabling outputs as repetitive signals having said certain frequency and applying said last-named signals to said vital driver means.

8. The invention according to claim 1 wherein said track switch has means for providing an output representing a request to unlock said switch, and said microprocessor means has means responsive to said unlock request output for providing said unlock enabling output only when said unlock request output is present.

9. The invention according to claim 8 wherein a plurality of said track switches are provided for switching trains between said section of said maintracks and different ones of a plurality of secondary tracks, and means for providing the unlock request when either of said switch means provides an output representing a request to unlock.

10. The invention according to claim 1 wherein said switch lock means further comprises watchdog timer means for resetting said microprocessor means unless reset within a given interval of time, and wherein said microprocessor means has means for resetting said watchdog timer means within said given period of time only so long as a microprocessor means is operative.

11. The invention according to claim 1 wherein said switch lock means has timer means operative to enable said unlocking output to be provided for a predetermined period of time.

* * * * *